US006128558A

United States Patent [19]

Kernwein

[11] Patent Number: 6,128,558

[45] Date of Patent: Oct. 3, 2000

[54] METHOD AND APPARATUS FOR USING MACHINE VISION TO DETECT RELATIVE LOCOMOTIVE POSITION ON PARALLEL TRACKS

[75] Inventor: Jeffrey D. Kernwein, Cedar Rapids, Iowa

[73] Assignee: Wabtec Railway Electronics, Inc., Germantown, Md.

[21] Appl. No.: 09/094,173

[22] Filed: Jun. 9, 1998

[51] Int. Cl.[7] ..... G05D 1/00

[52] U.S. Cl. ..... 701/19; 701/28

[58] Field of Search ..... 701/28, 19

[56] References Cited

U.S. PATENT DOCUMENTS

| | | | |
|---|---|---|---|
| 5,361,070 | 11/1994 | McEwan | 342/21 |
| 5,365,596 | 11/1994 | Dante et al. | 382/8 |
| 5,457,394 | 10/1995 | McEwan | 324/642 |
| 5,510,800 | 4/1996 | McEwan | 342/387 |
| 5,512,834 | 4/1996 | McEwan | 324/642 |
| 5,603,556 | 2/1997 | Klink | 303/22.6 |
| 5,630,216 | 5/1997 | McEwan | 455/215 |
| 5,786,750 | 7/1998 | Cooper | 340/425.5 |
| 5,790,403 | 8/1998 | Nakayama | 364/424.033 |
| 5,956,664 | 11/1999 | Bryan | 702/184 |
| 5,986,547 | 11/1999 | Korver et al. | 340/500 |
| 5,991,427 | 11/1999 | Kakinami | 382/104 |
| 5,992,036 | 7/1999 | Yasui et al. | 701/28 |

*Primary Examiner*—William A. Cuchlinski, Jr.
*Assistant Examiner*—Marthe Y. Marc-Coleman
*Attorney, Agent, or Firm*—McGuireWoods, LLP

[57] ABSTRACT

An automatic train control system, including a track occupancy detector is disclosed which utilizes an image sensor disposed on the front of a locomotive which scans an image immediately in front of the locomotive and is capable of detecting the presence of the occupied track and any parallel tracks disposed on either side of the occupied track. Image processing is accomplished using a Laplacian edge detection algorithm and a Hough transform line detection algorithm. An on-board computer determines the slope of lines corresponding to rails extending ahead of the locomotive. The lines are grouped into lines having positive and negative slope and the number of lines in each group is determined. Based upon the number of lines having positive and negative slopes, a determination of occupancy is made. The information from the track occupancy detector is provided to other equipment located on the locomotive and used to assist with other advanced train control functions.

21 Claims, 2 Drawing Sheets

METHOD AND APPARATUS FOR USING MACHINE VISION TO DETECT RELATIVE LOCOMOTIVE POSITION ON PARALLEL TRACKS

CROSS-REFERENCE TO RELATED APPLICATIONS

The application of present invention relates to and incorporates herein by these references co-pending patent applications entitled "Method and Apparatus for Controlling Trains by Determining a Direction Taken by a Train Through a Railroad Switch" by David H. Halvorson, Joe B. Hungate and Stephen R. Montgomery, and entitled "Apparatus and Method for Detecting Railroad Locomotive Turns by Monitoring Truck Orientation" by David H. Halvorson and Joe B. Hungate, both of which were filed on even date herewith, and are subject to assignment to the same entity as the present application.

BACKGROUND OF THE INVENTION

This present invention generally relates to railroads, and more specifically relates to train control systems and even more particularly relates to machine vision systems for resolving track ambiguity by determining the relative slope of lines corresponding to rails disposed in front of a locomotive.

In the past, train control systems have been used to facilitate the operation of trains. These train control systems have endeavored to increase the density of trains on a track system while simultaneously maintaining positive train separation. The problem of maintaining positive train separation becomes more difficult when parallel tracks are present. Often, parallel tracks exist with numerous crossover switches for switching from one track to another. It is often very difficult for electronic and automatic systems such as train control systems to positively determine upon which of several parallel train tracks a train may be located at any particular time. For example, when tracks are parallel, they are typically placed very close to each other with a center-to-center distance of approximately fourteen (14) feet.

In the past, several different methods have been attempted to resolve the potential ambiguity of which track, of a group of parallel tracks, a train may be using. These methods have included use of global positioning system receivers, track circuits and inertial navigation sensors. These prior art approaches of determining which track is being used each have their own significant drawbacks. Firstly, standard GPS receivers are normally incapable of positively resolving the position of the train to the degree of accuracy required. The separation of approximately fourteen (14) feet between tracks is often too close for normal GPS receivers to provide a positive determination of track usage. The use of differential GPS increases the accuracy; i.e. reduces the uncertainty in the position determined. However, differential GPS would require that numerous remotely located differential GPS transmitter "stations" be positioned throughout the country. The United States is not currently equipped with a sufficient number of differential GPS transmitting stations to provide for the accuracy needed at all points along the U.S. rail systems.

The track circuits which have been used in the past to detect the presence of a train on a particular track also require significant infrastructure investment to provide comprehensive coverage. Currently, there are vast areas of "dark territory" in which the track circuits are not available.

Additionally, these track circuits are subject to damage at remote locations and are susceptible to intentional sabotage.

The inertial navigation sensors proposed in the past have included both gyroscopes and acceleration sensors. The gyroscopes are capable of sensing a very gradual turn; however, gyros with sufficient accuracy to sense such turns are very expensive. Acceleration sensors, while they are less expensive than sensitive gyros, typically lack the ability to sense the necessary movement of a train especially when a high speed switch is being made from one parallel track to another at very low speeds.

Consequently, there exists a need for improvement in train control systems which overcome the above-stated problems.

SUMMARY OF THE INVENTION

It is an object of the present invention to provide a train control systems with enhanced positive train separation capabilities.

It is a feature of the present invention to include a digitizing imaging system to digitize the scene immediately in front of the locomotive.

It is an advantage of the present invention to allow for computer analysis of the scene immediately in front of a locomotive.

It is another object of the present invention to provide the ability to reduce track ambiguity.

It is another feature of the present invention to use image enhancement algorithms to simplify the view immediately in front of the locomotive.

It is another feature of the invention to use line detection algorithms to determine the slope of the lines corresponding to the rails in front of the locomotive and further including additional means for counting the lines which have predetermined slope characteristics.

The present invention is a method and apparatus for controlling trains by detecting the relative slope of the various parallel rails disposed immediately in front of the locomotive, which is designed to satisfy the aforementioned needs, provide the previously stated objects, include the above-listed features, and achieve the already articulated advantages. The invention is carried out in an "ambiguityless" system in the sense that the track ambiguity is greatly reduced by providing information to a train control system relating to the number of rails disposed immediately in front of the locomotive having predetermined slope characteristics.

Accordingly, the present invention is a method and apparatus for determining the location of a locomotive operating in a group of parallel tracks by utilizing machine vision systems to determine the relative slope of the lines representing the rails in a scene immediately in front of the locomotive.

BRIEF DESCRIPTION OF THE DRAWINGS

The invention may be more fully understood by reading the following description of the preferred embodiments of the invention, in conjunction with the appended drawings wherein.

DESCRIPTION OF THE PREFERRED EMBODIMENT

Figure 1:
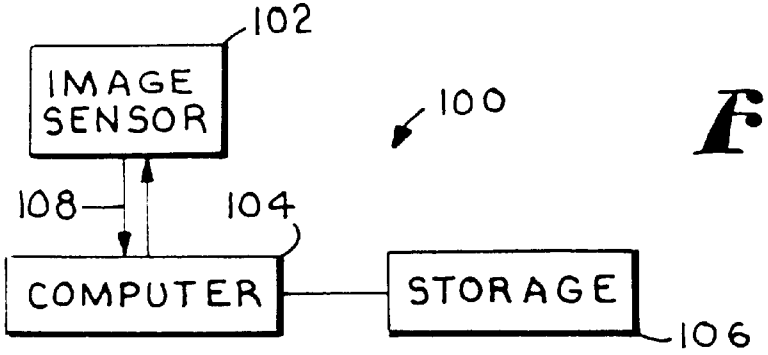
FIG. 1 is a block diagram representation of the turnout detector of FIG. 2.

Now referring to the drawings, wherein like numerals refer to like matter throughout, and more particularly to FIG. 1, there is shown a track occupancy detector, generally designated 100, having an image sensor 102 coupled to a computer 104 which is coupled to an information storage media 106. Preferably image sensor 102 is coupled to computer 104 through electronic connection 108. The image sensor 102 is preferably capable of resolving the location of rails disposed immediately in front of the locomotive and immediately adjacent to the locomotive.

Sensor 102 could include various types of sensors, such as black and white cameras, color cameras, or infrared cameras. The computer 104 is preferably capable of manipulating the information output by sensor 102 to determine the relative slope of the lines corresponding to the rails in the scene immediately in front of the locomotive.

The information storage media 106 is preferably coupled to computer 104 and could be included as an integral part of computer 104.

Figure 2:
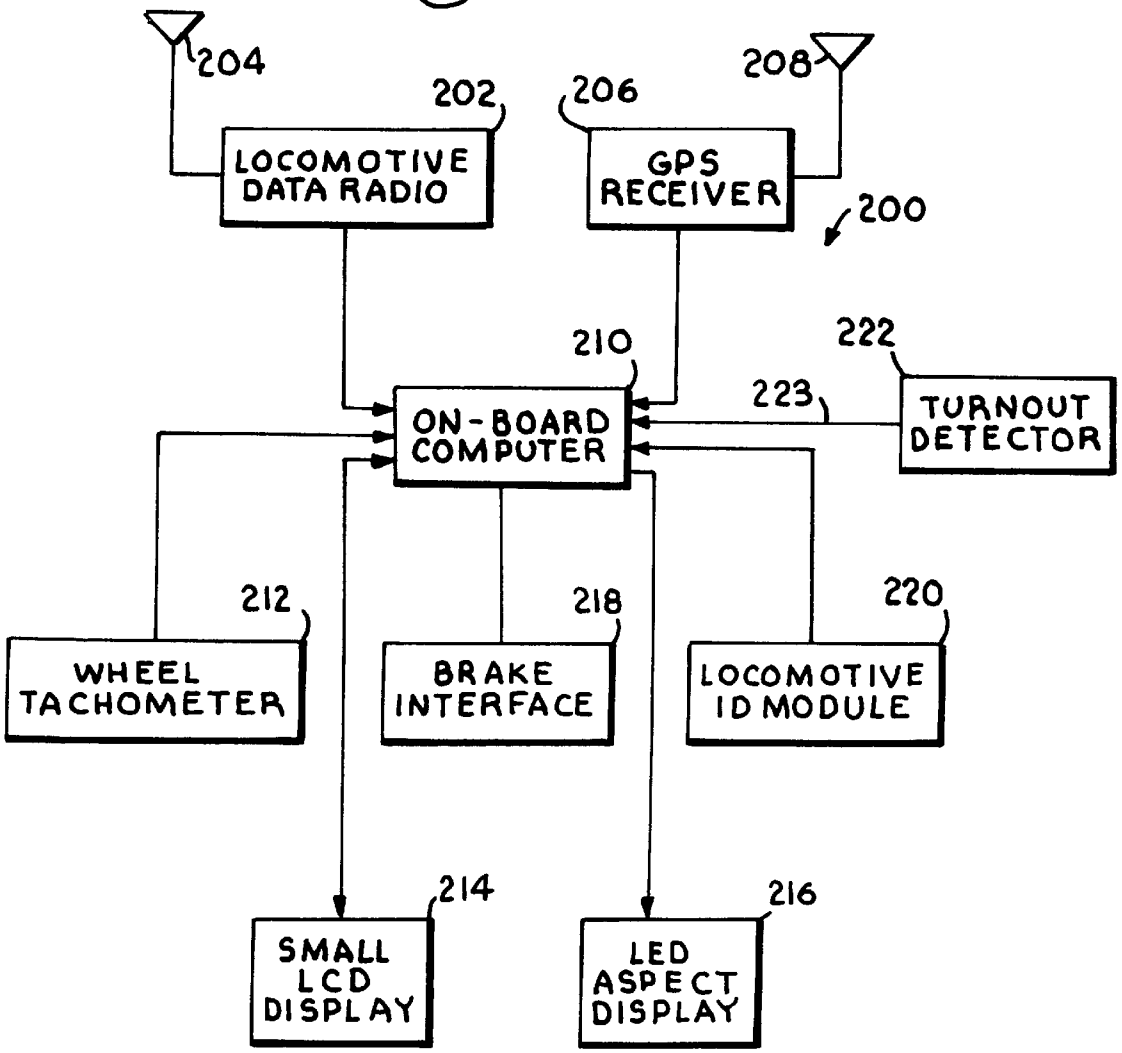
FIG. 2 is a block diagram of the train control system of the present invention.

Now referring to FIG. 2, there is shown an advanced train control system of the present invention generally designated 200 which would be found on board a locomotive (not shown). System 200 includes a locomotive data radio 202 which is coupled to an antenna 204 and further coupled to an onboard computer 210. Also coupled to onboard computer 210 is GPS receiver 206 which is coupled to a GPS antenna 208. Further coupled to onboard computer 210 is wheel tachometer 212, LCD display 214, LED aspect display 216, brake interface 218, and locomotive ID module 220. Radio 202, antennas 204, 208, GPS receiver 206, wheel tachometer 212, displays 214 and 216, brake interface 218, and locomotive ID module 220 are well known in the art. Onboard computer 210 may be a computer using a P.C. architecture or a custom embedded processor architecture. The processor and operating system and other details are subject to the desires of the system designer. On-board computer 210 may include a comprehensive rail track database. Coupled to onboard computer 210 is turnout detector 222, which is a generic name for devices capable of detecting if the train has made a turn or switched tracks. In the present case, the turnout detector 222 may be a track occupancy detector 100 as described more fully in FIG. 1 and its accompanying text. The operation of track occupancy detector 100 is also more fully described in FIG. 3 below.

Figure 3:
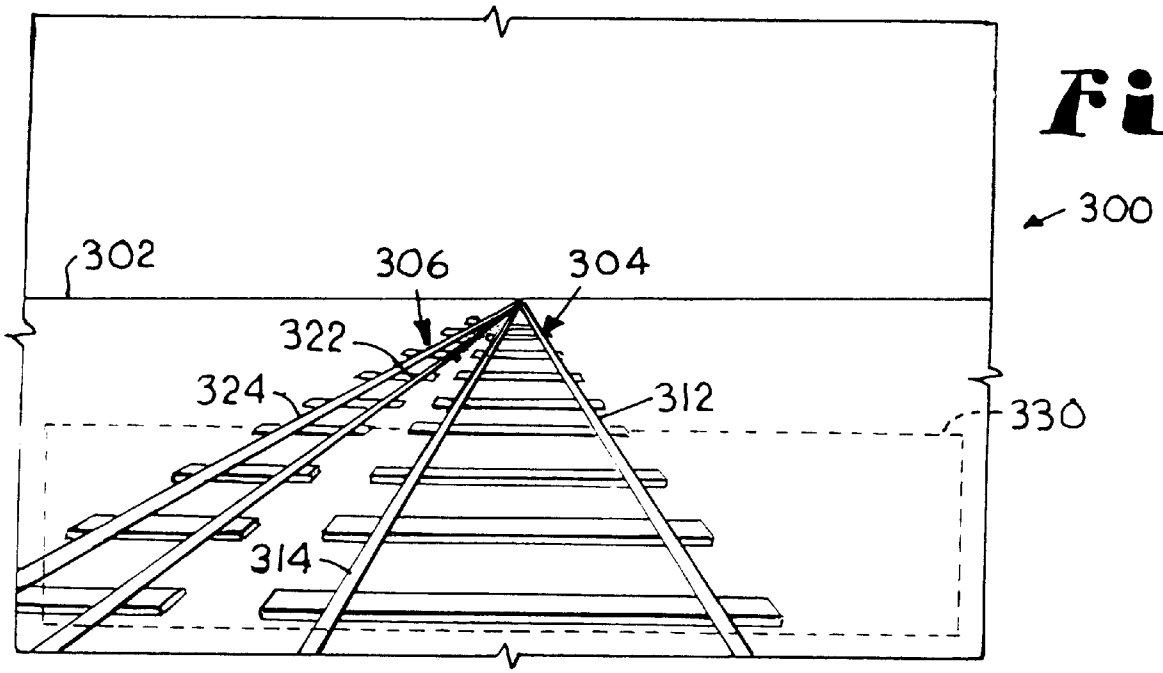
FIG. 3 is a representative view in front of a typical locomotive operating on an occupied track having a parallel track immediately adjacent thereto. The window at the bottom of FIG. 3 enclosed in dashed lines represents a subsegment of the entire view of FIG. 3 which would be monitored by the vision system.

Now referring to FIG. 3, there is shown a representative view of a scene immediately in front of a locomotive operating on a group of parallel tracks. The scene is generally designated 300. A simple horizon 302 is shown along with a first set of railroad tracks 304 and a second and adjacent set of railroad tracks 306. The first set of railroad tracks 304 includes a first rail 312 and a second rail 314, while second set of tracks 306 includes a first rail 322 and a second rail 324. In scene 300, tracks 304 are the tracks occupied by the locomotive. The scene 300 includes a machine vision scanning area 330 which is enclosed by the dashed line. It is this portion of the scene 300 which is monitored by the turnout detector 222 of FIG. 2. It also can be seen that the image sensor 102 of FIG. 1 appears to be centrally disposed on the locomotive and is "looking" or pointed in the direction of travel of the locomotive.

In operation, and now referring to FIGS. 1, 2 and 3, the image sensor 102 captures the image of the portion of the scene 330. Image enhancement algorithms are used by the computer 104 (or in an alternate embodiment by computer 210 in which image sensor 102 is coupled directly to onboard computer 210) to create a simple computer generated diagram that contains lines representing the location of rails within the desired field of view. Similarly, line detection algorithms could then be applied to the enhanced image to determine slope and intercept of each line representing a rail. The slope indicates the angle of each line, such that a positive slope denotes a slant upward to the right, and a negative slope denotes a slant downward to the right. The intercept of the lines indicates the point at which the line crosses an x-axis (assuming a normal Cartesian coordinate system).

In an area of a single track, there would exist one line with positive slope and another line with a negative slope. In an area of double tracks, there would exist three lines with positive and one line with negative slope or visa versa depending on which track was occupied. The distinction between having three lines of positive slope and one negative or three lines of negative and one positive will determine which set of rails is being occupied.

It is understood that the system of the present invention could take many forms. For example, the computer function as shown as 104 could be a dedicated microprocessor associated with the image sensor 102, or it could be a more robust microprocessor contained in a centralized on-board computer which could be a specially designed computer or a derivative of a computer having an architecture similar to a personal computer. The applicant believes that a person skilled in the art may desire to either choose to distribute the processing of information or consolidate it and otherwise tailor any particular system to meet particular needs of customers.

It is thought that the method and apparatus of the present invention will be understood from the foregoing description and that it will be apparent that various changes may be made in the form, construction, steps and arrangement of the parts and steps thereof, without departing from the spirit and scope of the invention or sacrificing all of their material advantages. The form herein described being a preferred or exemplary embodiment thereof.

Numerous image enhancement algorithms are known in the art, and it is contemplated that many algorithms such as a Laplacian edge detection algorithm could readily be used. Similarly, line detection algorithms are readily known in the art and line detection algorithms such as the Hough transform line detection algorithm could be utilized. The following is an example of a reference text which could be helpful in developing and tailoring image enhancement and line detection algorithms to meet particular implementation needs:

Digital Image Processing
by Rafael C. Gonzalez and Richard E. Woods
Addison Wesly Publishers
Copyright 1992
ISBN 0-201-50803-6

I claim:

1. A train control apparatus comprising:

an image sensor disposed on a rail vehicle and positioned so as to sense a scene immediately in front of said rail vehicle, said sensor generating sensor signals;

a computer for receiving said sensor signals and generating in response thereto line representations of rails of at least two sets of parallel tracks located within the scene immediately in front of said rail vehicle;

means for generating relative slopes of the line representations of rails relative to a reference line, the relative slope being either a positive slope or a negative slope; and means for determining track occupancy of the rail vehicle among the at least two sets of parallel tracks disposed in front of the rail vehicle based on the relative slopes of the line representations of the rails.

2. An apparatus of claim 1 wherein said generating means is a computer which utilizes an image enhancement algorithm to generate a simplified diagram containing the line representations corresponding to the location of the rails disposed in front of the rail vehicle.

3. An apparatus of claim 2 wherein said computer utilizes a line detection algorithm to determine the relative slope and an intercept of each line corresponding to a rail in front of the rail vehicle.

4. An apparatus of claim 3 wherein said computer separates the lines representing the rails into categories based upon the relative slope of such lines and determines whether each line has the positive slope or the negative slope associated with each category.

5. An apparatus of claim 4 further comprising a GPS receiver for providing position information relating to the position of said rail vehicle.

6. An apparatus of claim 5 further comprising a data radio for transmitting position information relating to positions derived from said GPS receiver and information relating to track occupancy derived from said image sensor.

7. An apparatus of claim 6 wherein said rail vehicle is a locomotive.

8. An apparatus of claim 7 wherein said computer utilizes Hough transform techniques to detect parallel tracks.

9. An apparatus of claim 8 wherein said computer utilizes Laplacian edge detection techniques.

10. An apparatus of claim 1 wherein said image sensor is a monochrome camera.

11. An apparatus of claim 1 wherein said computer is a microprocessor which is not dedicated solely for use in association with said image sensor.

12. An apparatus of claim 1 wherein said computer is a microprocessor dedicated solely for use in association with said image sensor.

13. An apparatus of claim 1, wherein the computer determines slope characteristics of rails associated with the at least two sets of parallel tracks for determining the track occupancy.

14. A train control apparatus for controlling a train of a type which operates on a track consisting of a pair of parallel rails and further of the type wherein the rail vehicle may occupy a track which is in a group of two or more parallel and closely spaced tracks, each track consisting of a pair of parallel rails, the train control apparatus comprising:

means for determining the number of rails disposed in an area immediately in front of said rail vehicle;

means for determining a relative slope of the rails immediately in front of the rail vehicle and further for determining the number of rails having slope characteristics of either a positive slope or a negative slope; and means for determining an occupancy characteristic for each set of tracks in front of the rail vehicle based on the slope characteristics of the rails.

15. An apparatus of claim 14 wherein said means for determining the number of rails comprises a means for sensing electromagnetic radiation reflected from rails disposed immediately in front of said rail vehicle.

16. An apparatus of claim 15 wherein said means for sensing electromagnetic radiation is a camera.

17. An apparatus of claim 16 wherein said means for determining the relative slope of the rails and the means for determining the number of rails having the slope characteristic is a computer processor.

18. An apparatus of claim 17 wherein said computer processor utilizes Hough transforms and Laplacian edge detection algorithms.

19. A method of determining which track, of a group of parallel railroad tracks (each track having a set of parallel rails), over which a rail vehicle is traveling comprising the steps of:

sensing reflected energy from a plurality of rails immediately in front of the rail vehicle;

determining the number of rails disposed immediately in front of the rail vehicle;

determining a relative slope of the rails disposed immediately in front of the rail vehicle with relation to the rail vehicle, the relative slope being characterized as either a positive slope or a negative slope;

determining the number of rails immediately in front of the rail vehicle having either the positive slope or the negative slope; and generating a track occupancy determination based upon the number of rails having the positive slope and the negative slope.

20. A method of claim 19 wherein said sensing of reflected energy is accomplished with a camera.

21. A method of claim 20 wherein said sensing of reflected energy is accomplished with an infrared camera.

* * * * *